United States Patent [19]

Pohrer et al.

[11] 4,139,762

[45] Feb. 13, 1979

[54] HUMIDIFIER

[76] Inventors: Harry H. Pohrer, 824 Brentford Dr., St. Louis, Mo. 63125; Emil A. Singler, 11062 Little Dr., St. Louis, Mo. 63126

[21] Appl. No.: 770,444

[22] Filed: Feb. 22, 1977

[51] Int. Cl.[2] ..... F24F 3/14

[52] U.S. Cl. ..... 219/362; 126/113; 137/392; 219/271; 219/272

[58] Field of Search ..... 219/271-273, 219/362, 333; 126/113, 134; 236/44 R, 44 E, 44 C; 237/78; 137/392

[56] References Cited

U.S. PATENT DOCUMENTS

| | | | |
|---|---|---|---|
| 2,236,359 | 3/1941 | Armstrong | 219/271 |
| 2,883,511 | 4/1959 | Gooldy | 219/362 |
| 3,007,178 | 11/1961 | Altman et al. | 219/362 |
| 3,170,479 | 2/1965 | Mueller | 137/392 |
| 3,209,125 | 9/1965 | Morrissey | 126/113 |
| 3,215,416 | 4/1965 | Liben | 126/113 |
| 3,523,175 | 8/1970 | Gygay | 126/113 |
| 4,027,172 | 5/1977 | Hamelink | 137/392 |

*Primary Examiner*—J. V. Truhe
*Assistant Examiner*—Bernard Roskoski
*Attorney, Agent, or Firm*—Charles B. Haverstock

[57] ABSTRACT

A humidifying device automatically controllable to discharge an abundant supply of steam into the outlet or plenum chamber of an associated air handling apparatus such as a forced air furnace in a home or other structure to provide and maintain a desired preselected humidity condition, which device includes a tank having a chamber for holding a supply of water to be vaporized, said tank having an inlet into said chamber through which water can flow, a valve associated with said inlet for regulating the inlet water flow and a conduit for connecting said valve to a source of water, a probe member mounted on the tank and extending downwardly therein from an upper location, a heating element extending into said chamber near the bottom thereof, a steam outlet near the top of the tank through which steam produced in the chamber can escape, a second conduit having one end connected to the steam outlet and an opposite open end for connection to the plenum chamber of the furnace in position to discharge steam from said outlet into the plenum chamber, an electrolytic substance in said chamber mixing with the water therein to improve the electrical conductivity thereof, and an electrical circuit associated with the device for controlling the operation thereof, said control circuit including a first circuit portion including the probe operatively connected to the water valve to control the opening and closing thereof, said first circuit portion including a circuit connection established when the water in the tank comes into contact with the probe to close the water valve, and a second circuit portion including a humidistat for controlling the energizing of the heating element to vaporize the water in the chamber and produce steam, said second circuit portion including connections for simultaneously energizing a blower of the furnace to assure that steam fed into the plenum chamber will be introduced into a moving air stream. The present device may also include a delay mechanism connected in said first circuit portion including an electrical circuit element operable to maintain the water valve in an open condition for a predetermined time interval after the water in the tank initially rises to a level such that it comes into contact with the probe.

18 Claims, 4 Drawing Figures

HUMIDIFIER

This invention relates generally to humidifiers, and more particularly to a versatile humidifying device for use with an air handling apparatus such as a forced air furnace in a home or the like.

Many devices have been devised and used for adding humidity to air circulated throughout homes, offices, factories, in saunas, and the like; but, all of the known devices have certain shortcomings and disadvantages. Many of the known devices, for example, are incapable for adding sufficient humidity quickly enough to be practical for use in many applications including in many buildings and in places such as sauna baths or the like where relatively high levels of humidity are required. Also, all of the known devices include features such as mechanical floats, filters or water absorbing plates, all of which are susceptible to corrosion, to being damaged or to malfunctioning. This means the known devices require frequent servicing, cleaning or other maintenance attention for effective operation, and even then they provide only relatively limited amounts of humidity. Furthermore, the known devices for the most part are difficult and time consuming to install, and require substantial modification and changes to be made in the structural and operational features of the furnace or other air handling apparatus with which they are used. Some of the known devices also require some of their component parts to be positioned within the plenum chamber of the furnace. When this is done, it blocks off a portion of the plenum chamber and thereby diminishes the air flow capacity of the furnace, and sometimes undesirably effects the electrical and/or mechanical portions of the furnace as well. In addition, the known devices for the most part are relatively inefficient and costly to operate, none of them can be as accurately controlled as the present device, and none provides as much humidity.

The present invention teaches the construction, installation and use of a novel humidifying device which overcomes these and other shortcomings and disadvantages of the known devices. For example, the subject device is capable of adding more humidity in less time than any known device, and it can be more accurately controlled to provide and maintain almost any desired level of humidity. These advantages make the subject device well suited for use in a wide variety of different structures including homes, offices, factories, steam baths, and sauna baths and other places where relatively large amounts of humidity are required. Furthermore, the subject device can be relatively quickly and easily installed for use with existing air handling apparatus such as forced air furnaces, and requires no modification of the operational features of the furnace for its installation and use. Use of the present device also requires only slight changes to be made in the structural features of the furnace, and it does not require the placement of any parts within the plenum chamber. The subject device is also very efficient in its operation, relatively inexpensive to operate, and does not require or include any parts such as mechanical floats, filters, water absorbing plates or other parts that are likely to corrode, to become damaged or to malfunction, or to require servicing or other maintenance attention for continued effective operation. The present device is also relatively simple structurally and lends itself to mass-production techniques.

Among other features, the subject device in its preferred form includes a boiler tank or housing which has a chamber therein for holding a supply of water to be vaporized. The tank has inlet means through which water from an external source can flow into the tank chamber, and valve means are associated with the inlet means for regulating the inlet water flow. With the subject device, electrical as opposed to mechanical means are provided for controlling the opening and closing of the valve means and thereby the flow of water into the tank chamber. The electrical control means include a probe attached to the tank at an upper location which extends downwardly into the upper portion of the chamber. The probe is useful in automatically maintaining the water depth in the chamber.

The present device also has a heating element extending into the chamber near the bottom thereof which can be selectively energized to heat the water supply sufficiently to produce steam, and it has a steam outlet near the top of the tank through which the steam produced in the chamber can escape. In addition, a conduit having one end connected to the steam outlet and an opposite open end connected to the plenum chamber of the furnace or other air handling apparatus is provided so that the exiting steam produced in the tank chamber can be fed directly into an air stream moving through the plenum chamber. The effect produced is similar to that of a tea kettle exhausting an abundant supply of steam into the plenum chamber, but under precisely controlled conditions allowing almost any desired and preselected humidity condition to be attained and continuously maintained in the home or other structure.

The present device in its preferred form is an automatic device that is electrically controlled, and an electrical control circuit is included and will be described. The electrical control circuit includes a circuit portion for opening and closing the water valve to maintain a predetermined supply of water in the chamber, and another circuit portion which includes the probe and a non-vaporizable electrolyte in the water in the tank for controlling the circuit means that open and close the water valve to control and maintain a desired water level. The control circuit also has another portion which includes a humidistat for selectively energizing the heating element to heat the water in the chamber sufficiently to vaporize it and produce steam, and for simultaneously energizing the furnace blower or fan to make sure that the steam is introduced into a moving air stream in the plenum chamber. In addition, the control circuit may include a delay feature or mechanism to maintain the water valve in an open condition for a short time interval after the water within the chamber rises sufficiently to make contact with the probe. This is done to reduce the frequency at which the water valve is energized and deenergized.

It is therefore a main object of the present invention to provide a humidifying device capable of producing an abundant supply of humidity to be introduced directly into the plenum chamber of a furnace or like apparatus, which device can be accurately controlled to provide and maintain almost any desired preselected humidity condition.

Another object is to provide a humidifying device which can be quickly and easily installed for use with existing air handling apparatus such as forced air furnaces and the like, which device requires little or no modification of the structure or operation of the furnace.

Another object is to provide a humidifying device which can be connected for use with a forced air furnace without requiring substantial structural changes to be made in the furnace, and without requiring the placement of any of its parts or components within the furnace including within the plenum chamber thereof.

Another object is to provide a humidifying device which is well suited for use in homes, offices, factory buildings and the like, and which can also be used to provide the steam required in sauna baths and other places where relatively high humidity levels are required.

Another object is to provide a relatively durable and maintenance-free humidifying device which does not require any movable parts such as mechanical floats, or any filters, screens or other parts that are susceptible to becoming corroded, damaged or to malfunctioning.

Another object is to provide a humidifying device which includes a boiler tank or housing having a chamber therein in which a supply of water to be evaporated is maintained, which device has electrical as opposed to mechanical control means for monitoring and maintaining the level of water in the chamber.

Another object is to minimize maintenance and servicing of humidifying devices.

Another object is to provide an abundant yet controlled supply of steam for delivery directly into a stream of air to be circulated throughout a home or other structure.

Another object is to provide an efficient and relatively inexpensive to operate humidifying device.

Another object is to provide a humidifying device which can be used for supplying steam to a sauna bath or similar structure.

Another object is to provide a humidifying device which can be used to introduce a pleasant odor into a house or other environment.

Another object is to provide a humidifying device which can be connected to receive pre-heated water from a source of water such as from the output side of a hot water heater thereby reducing the time and energy required for producing steam.

Another object is to provide a relatively compact, trouble free, easy to install and operate humidifying device which can be connected for use with an existing as well as with a new furnace or like installation.

Yet another object is to teach the construction, operation and installation of a humidifying device which can be installed by persons having relatively little skill and training.

These and other objects and advantages of the present invention will become apparent after considering the following detailed specification which covers a preferred embodiment thereof in conjunction with the accompanying drawing wherein like numerals refer to like parts wherever they occur, and wherein.

Figure 1:
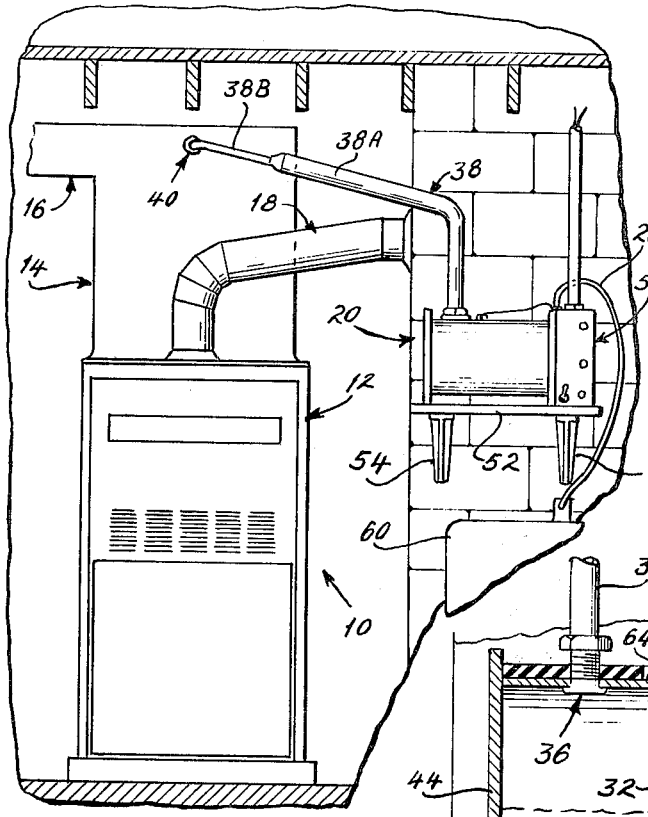
FIG. 1 is an elevational view of a portion of a forced air furnace of a type commonly used in homes and other places, and showing a humidifying device embodying principles of the present invention installed for use therewith.

Referring to the drawing more particularly by reference numbers, number 10 in FIG. 1 generally identifies a forced air furnace system similar to those commonly used for heating and circulating air throughout homes and other structures. The system 10 includes a furnace 12 which has a blower (not shown) positioned therein in the usual way so that the hot air produced in the furnace is blown through an outlet or plenum chamber 14 and from the plenum chamber into one or more ducts such as duct 16 which discharge the hot air into the environment within a home or other structure. The system 10 also includes return ducts (not shown) for returning cold air to the furnace 12 for heating and recirculation in the usual manner. Also, the system 10 has a connection 18 to a chimney or other structure for exhausting the products of combustion. Number 20 in FIG. 1 identifies a humidifier device for operation in conjunction with the furnace system 10, and constructed according to a preferred form of the invention.

Figure 3:
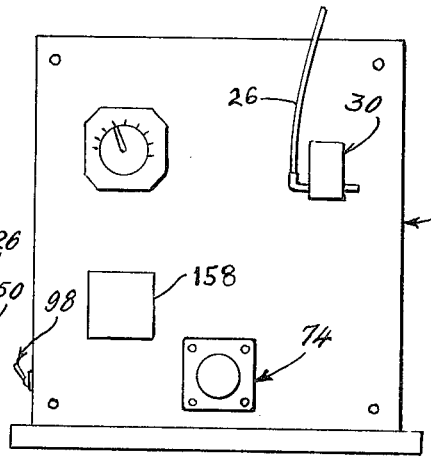
FIG. 3 is a right end elevational view of the humidifying device shown in FIGS. 1 and 2, said device being shown with a cover plate and its electrical wiring removed for clarity; and, FIG. 4 is a schematic circuit diagram of an electrical circuit for use with the subject device.
Figure 2:
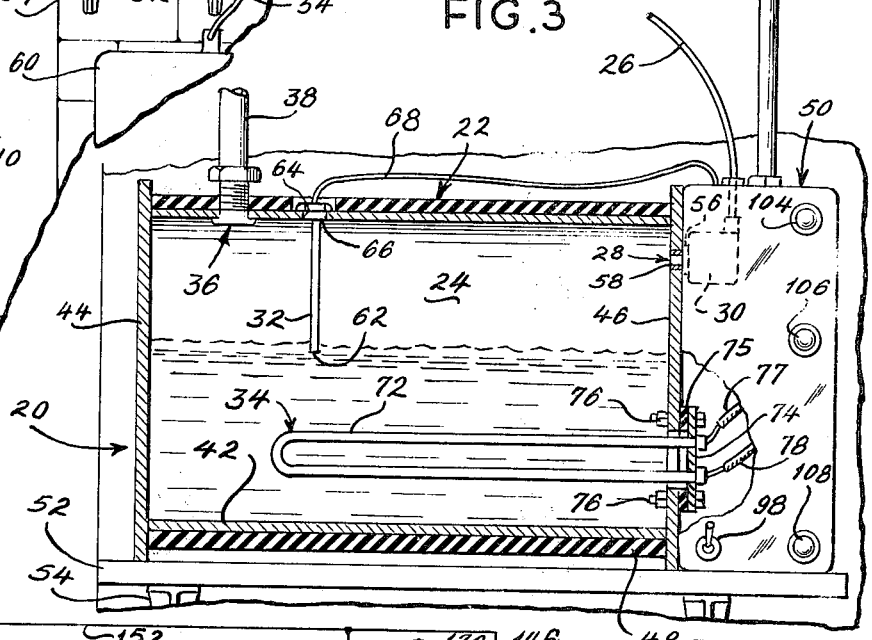
FIG. 2 is an enlarged cross sectional view taken through the center of the subject humidifying device.

As best seen in FIG. 2, the subject humidifying device 20 includes a tank portion or housing 22 which has a chamber 24 therein for holding a supply of water to be vaporized. Water is fed into the chamber 24 from a source such as from the outlet side of a hot water heater or other source through inlet means such as conduit 26, inlet port 28, and valve means such as solenoid controlled valve means 30 shown in FIG. 3, which valve means are associated with the conduit 26 and used to control the inlet water flow. The device 20 has electrical means which will be described later for controlling the opening and closing of the water valve 30 and thereby the flow of water into the tank chamber 24. The means provided for this purpose include an electrical probe such as probe 32 which is attached to the tank 22 at an upper location and extends downwardly therefrom into the chamber 24. The probe 32 senses the water in the tank chamber 24 and operates to control the opening and closing of the water valve 30.

The device 20 also has an electrical heating element 34 which is mounted extending into chamber 24 near the bottom thereof. The element 34 is used for heating the water in the chamber sufficiently to vaporize it and produce steam. The device has a steam outlet 36 located near the top of the tank 22 above the water level through which the steam produced in the chamber 24 can escape. A conduit 38 has one of its ends connected to the steam outlet 36 and its opposite end attached to the furnace 12 as at 40 in position to discharge the steam exiting therefrom into the plenum chamber 14 of the furnace. It is important that the exiting steam be introduced into the plenum chamber 14 directly into the stream of the hot air that is being produced by the furnace 12 so that it will be carried thereby into the home.

In the form of the device illustrated, the tank 22 is shown including a horizontally oriented cylindrical side wall 42 which has end wall members 44 and 46 attached to opposite ends thereof by welding or otherwise. This construction and orientation for the tank 22 provides a relatively large evaporation surface for the water in the chamber 24. Also, it has the advantage of being relatively simple and economical to make, and lends itself to mass production techniques. It will be realized, however, that other constructions and shapes can be used for the tank 22 as well. The walls 42, 44 and 46 which enclose and define the chamber 24 are preferably formed of a material which is relatively resistant to corrosion. Materials such as galvanized steel, stainless steel, aluminum, brass or the like, or even certain plastic materials having relatively high thermal stability characteristics can be used for this purpose. One or more walls of the tank 22 are also preferably provided with an outer covering such as covering 48 of a thermal insulating material to minimize possible heat loss from the chamber 24, and a control box 50 may be attached to the end wall 46 of the tank 22 as shown. The control box 50 contains the water valve 30 and many of the electrical components used to control the operation of the subject device as will be later described. The tank 22 together with the attached control box 50 can be mounted at any suitable location preferably near the furnace and preferably also near a source of water such as a hot water tank. For example, it can be mounted on or adjacent to a wall of the home using a platform 52 and support brackets 54 (FIG. 1) if desired, or the device can be mounted on or adjacent to a sidewall of the furnace 12 or at some other convenient location.

The water inlet port 28 through which water is fed into the chamber 24 is shown including a fitting 56 of known construction adapted to receive one end of a conduit 58 which has its opposite end connected to the water valve 30. The water valve 30 can also be connected directly to the end wall 46 of the tank 22 if desired, and suitable fittings for accomplishing this will be required. The water valve 30 may also be mounted inside of the control box 50 to keep all of the electrical connections as short as possible and to make the device more compact and self contained. The water valve 30 is connected to one end of the conduit 26 which extends from the control box 50 and has its opposite end connected to a suitable water source such as to the hot water outlet of a hot water tank 60 as shown in FIG. 1. While the present device can be usually connected to any kind of a water source, when possible it is preferred to connect the conduit 26 to the outlet side of a hot water heater since the water at the outlet side of a hot water tank is already hot and therefore the subject device will require less energy to vaporize the water it receives to produce steam. This increases the efficiency of the device 20 without placing a substantial drain on the output of the hot water heater since the present device normally requires relatively little of the total output of the hot water heater. It may also be desirable in cases where the present device receives its input water from a hot water source to insulate the conduit 26, although the necessity for doing this will depend upon the distance between the hot water heater and the subject device and any amount of heat that might be lost by the connection will be relatively minor and a simple unwrapped copper tube is all that is normally required.

The subject device 20, as indicated above, is preferably controlled by electrical as distinguished from mechanical means. The electrical means provided include means for controlling the opening and closing of the water valve 30 to control the water level in the tank 22, means for energizing and de-energizing the heating element 34, and other means including circuit means to a humidistat, to indicator lights and to the controls for the furnace blower. The electrical control means may also include a delay means to minimize the on and off cycling of the water valve 30 as will be described.

The electrical control means for opening and closing the water valve 30 are under the control of the probe 32 and the water contained in the tank chamber 34. For the most efficient operation, the water in the tank chamber 24 preferably contains a non-vaporizable electrolytic substance such as a salt of some kind. The salt may be placed in the chamber at the time it is manufactured and is an electrolyte which mixes with the water in the tank 22. The probe 32, as stated, is attached to the tank 22 at an upper location, and extends downwardly inside the tank to an intermediate location in the chamber 24 with a lower free end 62 of the probe 32 located approximately at the desired level of water to be maintained in the tank 22. In the illustrated case, a suitable hole 64 and an electrical insulating fitting 66 are provided for mounting the probe 32 in the position described. The probe 32 is constructed of an electrically conductive material, and the portion of the probe which extends outside of the tank 22 has a lead 68 attached thereto. The lead 68 extends from the probe 32 into the control box 50. The fitting 66 in which the probe 32 is mounted, may be constructed to be relatively easily removed from the hole 64 for introducing the electrolytic substance into the chamber 24 although the electrolytic substance or salt can also be introduced into the tank chamber 24 at other locations including at the location where the steam outlet conduit 38 is connected to the tank 22 and so forth. The hole 64 can also be used when the fitting 66 is removed for introducing another substance such as an odor or fragrance producing substance into the water in the chamber 24 thereby enabling the subject device to generate steam that has a scented fragrance.

The operation of the probe 32 in controlling the energizing and de-energizing of the solenoid controlled water valve 30 and the feeding of water into the tank will be described more fully hereinafter along with the operation of the total electrical control circuit for the subject device 20. At this point, it is sufficient to note that when the water level in the tank chamber 24 is below the lower end of the probe 32 the water valve 30 will be energized and open to feed in water and as the water lever rises during a filling operation, it will eventually come into contact with the lower end 62 of the probe 32. When this happens, a ground connection will be completed by way of the probe 32 and the electrically conductive water in the chamber 24. The ground will operate to deenergize and therefore close the water valve 30 in a manner to be described. Likewise, when the water level in the tank chamber 24 is below the lower end 62 of the probe 32 so that the probe is no longer in contact with the water, the circuit previously established will be interrupted. This interrupted circuit condition between the probe 32 and the water in the chamber 24 will cause another electrical circuit to be established to energize the water valve 30, causing it to open and the filling of the tank to commence. The cycling of the water valve 30 is important to the operation at the present device 20, and is preferably also controlled through the use of delay means which cause water to continue to be fed into the tank for a time period after the water level has risen to engage the probe. The delay feature is provided so that the water level will rise slightly above the lower end 62 of the probe during each filling operation thereby substantially reducing the cycling frequency of the water valve and making the device less noisy.

The electric heating element or coil 34 is mounted on the end wall 46 by suitable insulated mounting means and the electrical connections therefor are located in the control box 50. The heating element 34 includes a loop portion 72 which extends into the chamber 24 preferably near the bottom thereof below the water level that is normally maintained in the tank chamber and is usually immersed. The heating element 34 may include a mounting plate 74, a gasket 75 and suitable members 76 for attaching it to the wall 46. Other forms for mounting the heater element 34 could also be used depending upon circumstances, but it is usually desirable to attach the heating element in a manner such that it can be removed for maintenance and other purposes as required. The important thing is that the heater element 34 be mounted so that the loop portion 72 extends into the tank chamber 24 at an elevation below the lower end 62 of the probe 32 and therefore below the level at which the water is to be maintained. When the heater element 34 is energized, it will raise the temperature of the water to the boiling point and steam will be produced in the chamber 34 above the water level. The pressure of the steam will produce a tea kettle effect that forces the steam out through the steam conduit 38 and into the plenum chamber 14 of the furnace. The heater element 34 is connected by electric connectors 77 and 78 to the control circuit for the subject device and the energizing and de-energizing of the heater element 34 is under control of a humidistat 80 which monitors the level of humidity in the controlled environment of the home or factory, and when the level of the humidity falls below a desired level the humidistat 80 will produce an electrical response that causes the heater element 34 to be energized to produce steam. When this occurs the furnace blower motor (not shown) must also be energized so that the steam will be introduced into a moving stream of hot air in the plenum chamber 14. Eventually the humidistat 80 will sense that the desired humidity level has been reached and will operate circuit means which interrupt the energizing of the heater element 34 and operation of the subject device (and possibly also the operation of the furnace blower although the furnace and the furnace blower are usually primarily under control of a thermostat).

The steam pressure produced in the chamber 24 forces the steam through the steam outlet 36 and the conduit 38 as aforesaid. The steam outlet 36 includes a suitable fitting which is provided to connect to the conduit 38 and should be such that it prevents undesirable leakage and so forth. The discharge or outlet end of the conduit 38 is preferably open ended and extends through a hole in the plenum chamber wall. A fitting can also be used for making this attachment and to provide support for the free end of the conduit 38. Usually only a relatively small hole is needed in the wall of the plenum chamber for this purpose as distinguished from other humidifier devices including those which are mounted inside of the plenum chamber and which require substantial openings for their mountings. It is important that with the present device there is nothing that needs to be located inside of the plenum chamber to interrupt a flow of hot air from the furnace to the duct work and this is an advantage of the present device. It is desirable, however, to locate the open end of the conduit 38 in such a position that it introduces the steam directly into the moving hot air stream of the furnace. By introducing the steam into a moving hot air stream, the steam is carried more directly into the controlled environment and there is less chance for condensation to form which might cause corrosion and other undesirable conditions. If desired, a suitable insulating wrapping material (not shown) can be applied to the steam conduit 38 to further reduce the possibility of condensation formation and to increase the efficiency of the system. This may not be necessary, however, if the distance between the subject device and the plenum chamber is relatively short. The steam pipe 38 can also have a larger diameter portion 38A which extends upwardly from the humidifier and a smaller diameter end portion 38B which discharges steam. This is done to drain back to the humidifier a maximum of condensation that may settle in the steam pipe 38A. As indicated above, the subject device can be used to supply steam to a sauna bath, a steam room, or any other environment where it is desired to add humidity.

Figure 4:
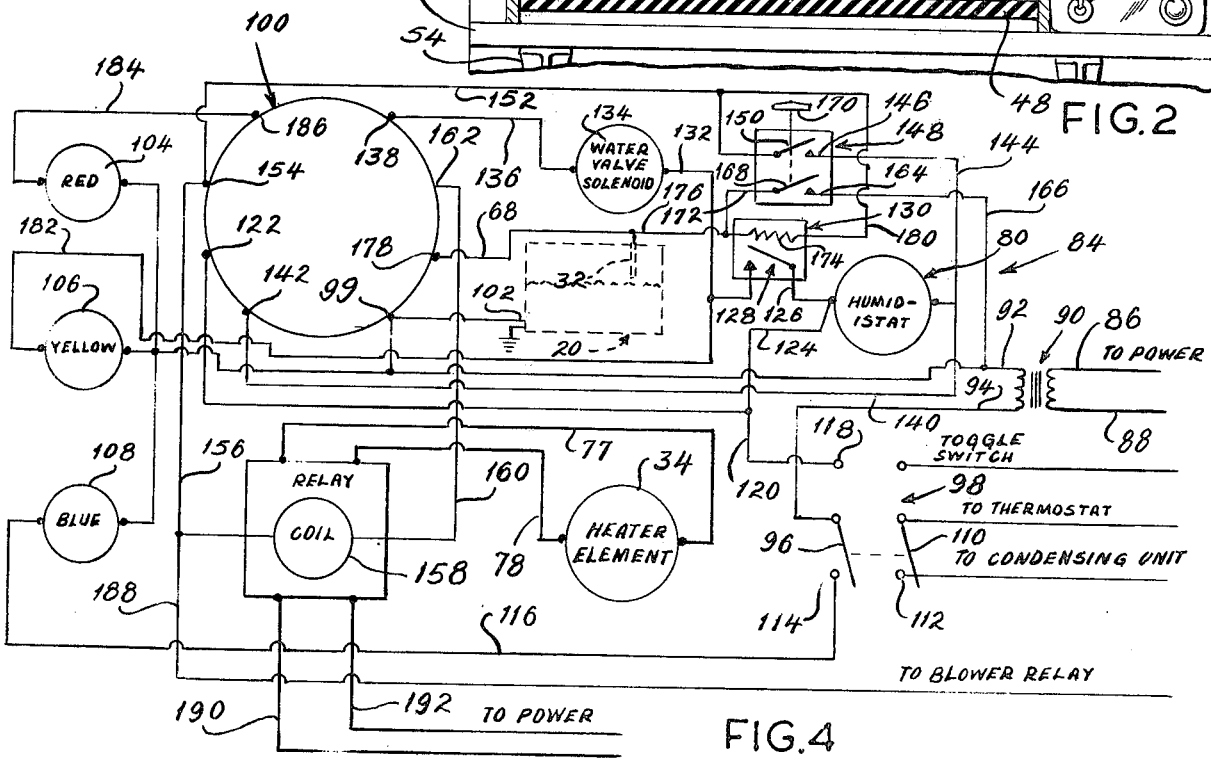

FIG. 4 shows an electrical control circuit 84 for controlling the operation of the subject device 20. Most of the circuit 84 and the circuit components are contained in the control box 50, and the circuit is connected by leads 86 and 88 to a suitable power source such as an A.C. source. The power leads 86 and 88 are connected to one side of a step down transformer 90 which converts the voltage to a lower operating voltage which is present on conductors 92 and 94. The conductor 94 is connected to a movable switch contact 96 which is included in switch 98 shown mounted on a side wall of the control box 50. The conductor 92 is connected to a terminal marked 99 on a control relay 100 and is grounded to the tank 22 at 102. The conductor 92 is also connected to one side of three different indicator lights 104, 106 and 108. The indicator lights 104, 106 and 108 are optional features of the subject device 20 and are identified in FIG. 4 as red, yellow and blue lights, respectively. The lights are located on the side wall of the control box 50, and indicate the three operative modes of the device, namely, the on or operating mode (yellow light), the off or standby mode which is also the mode used when air conditioning instead of heating is used (the blue light), and the operative mode at times when water is being fed to the tank (the red light).

The switch 98 is shown as being a toggle switch which has two ganged together movable contacts 96 and 110 with the contact 110 being connected in a control circuit for an air conditioning unit or some other structure. The connections to the switch 98 prevent possible starting of the air conditioner when the subject humidifier device is in operation and vice versa. When air conditioning instead of humidity is desired, the switch 98 is moved to a position in which the contact 110 is in engagement with switch terminal 112, closing the control circuit to the air conditioner and allowing it to operate instead of the humidifying device 20. Moving the movable switch contact 110 to the position for air conditioning simultaneously moves the switch contact 96 into engagement with switch terminal 114 which is connected in the circuit to energize the blue indicator light 108 by way of conductor 116. This gives a visual indication that the air conditioning unit instead of the humidifying device 20 is in operation. The switch 98 has different operating positions, one for air conditioning as described, one in which the movable contacts 96 and 110 are both open circuited which is the inoperative position, and one in which the switch contact 96 is engaged with stationary switch contact 118 in which condition the subject humidifier is activated. A conductor 120 is connected between the switch contact 118 and terminal 122 of the control relay 100 so that when the movable switch contact 96 is moved into engagement with the stationary contact 118 an electrical circuit is established thereto for reasons which will be explained.

The conductor 120 is also connected by lead 124 to one side of the humidistat 80 and by lead 126 to one side of normally open switch contact 128 of heat sensitive sequencer 130. The opposite side of the switch contact 128 is connected by lead 132 to one side of solenoid coil 134 which is the solenoid that controls the water valve 30. The opposite side of the solenoid 134 is connected by lead 136 to terminal 138 of the control relay 100. When the water level in the tank 22 is below the level of the probe 32 a normally closed circuit will be established through the control relay 100 from the terminal 138 to the terminal 99, which is grounded to the tank 22, to energize the solenoid 134 if other circuit conditions are established as will be described. The other conditions referred to include fail safe features which prevent energizing of the solenoid 134 under certain conditions including to prevent flooding.

The opposite side of the humidistat 80 is connected by lead 140 to terminal 142 of the control device 100, and by lead 144 to the stationary contact 146 of a normally open push button reset switch 148. The contact 146 cooperates with a movable contact 150 which is connected by lead 152 to terminal 154 on the control device 100. The terminal 154 is also connected by another lead 156 to one side of a heater relay coil 158 which controls the energizing and deenergizing of the heater element 34. The other side of the relay coil 158 is connected by lead 160 to terminal 162 of the control device 100.

The reset switch 148 has a second stationary contact 164 which is connected by lead 166 to the low or grounded input lead 92 from the step down transformer 90. A second movable switch contact 168 is ganged to operate with the movable switch contact 150 and both movable contacts are controlled by the same push button 170. The movable switch contact 168 is connected by lead 172 to one side of heater element 174 in the sequencer 130, by lead 176 to the probe 32, and by the lead 68 to terminal 178 on the control device 100. The opposite side of the sequencer heater element 174 is connected by lead 180 to the movable push button contact 150 and from there by the lead 152 to the terminal 154.

The sequencer 130 is constructed such that when current passes through the heater element 174 it will operate to close the normally open contact 128 to complete a circuit which will enable the water valve solenoid 134 to be energized. It is to be understood that the water valve 30 should open to permit water to flow into the tank 22 whenever the device is operating and the water level is below the lower end 62 of the probe 32. However, when the device is first placed in operation and at the beginning of each heating season when it is switched on, it is necessary for the operator to apply pressure to maintain the push button contacts 150 and 168 closed for a long enough time for the heater 174 to close the contact 128. This is necessary because until the contact 128 closes it is not possible to energize the water valve solenoid 134. In a typical application it takes about forty-five seconds for this to happen. This is a desirable time period because the normal water filling cycle is about fifteen seconds, and this fact is made use of to prevent the device from falling out of operation during a filling cycle as will be explained.

The circuit for energizing the water valve solenoid 134 is from the switch terminal 118, the leads 120, 124 and 126 to and through the sequencer switch 128 which is closed when the device is in operation and after the push button 170 has been depressed for at least forty-five seconds, to and through the water valve solenoid 134, on the lead 136 to the terminal 138 and through the internal wiring in the device 100 to the grounded terminal 99. This circuit will maintain the water valve solenoid 134 energized until the water level rises to engage the probe 32. When this happens another circuit will be established from the probe 32 by way of the lead 68 and the terminal 178 to energize means in the control device 100 to break the internal connection between the terminals 138 and 99. The device 100 preferably includes means to delay this circuit interruption for some time interval such as fifteen seconds to permit the water level to rise somewhat above the lower end 62 of the probe 32 to reduce the cycling frequency.

After the water level rises to meet the probe 32 a ground connection is established from the probe 32 and the water which contains a salt or other electrolyte to the grounded tank 22. This ground connection maintains current flow through the sequencer heater 174 which is connected by the leads 180 and 152 to the terminal 154 which is connected to the opposite or non-grounded side of the power supply. As long as the water level is engaged with the probe the heater 174 will be energized to maintain the contact 128 closed. Furthermore, when the water level is below the level of the probe 32 the water valve will be energized to feed in more water. If the time required to bring the water level up to the probe 32 exceeds forty-five seconds the heater 174 will cool sufficiently for the switch 128 to open and shut off the device. Usually, however, it only takes about fifteen seconds or so to restore the water level and therefore the switch 128 should remain closed at all times when the device is operating. If for any reason the switch 128 should open it will be necessary to hold the push button switch 148 closed for at least forty-five seconds to allow time for the heater 174 to reclose the switch 128 and restore normal operation. This provision in the subject circuit is a fail safe provision which is included to prevent overfilling and flooding since as explained above the control device 100 must include a normally closed circuit in order for the water valve 30 to open and feed in water when the water level is below the lower end 62 of the probe 32. Note also that the yellow panel light 106 is also controlled by the sequencer switch 128 through lead 182. The red light 104, on the other hand, is energized and de-energized with the water valve solenoid 134 through lead 184 which is connected to terminal 186 on the control device 100. For ease in understanding it is noted that the four left side terminals 186, 154, 122 and 142 on the device 100 are the high or hot terminals while the other or right side terminals 138, 162, 178 and 99 are low or ground side terminals.

The control device 100 may be of a known construction, and one such device which has been used for this purpose is manufactured and sold by Paragon Electric Co., Inc. and is identified on the devices by the legend Solid State Timer "On Delay" -1-10 Sec. Model 545-011-6. This device includes internal circuit connections and elements which operate to maintain the water valve 30 in an energized condition for the relatively short additional time period after the water level in the tank 22 has risen during a filling operation to a point of initially making contact with the lower end 62 of the probe 32. The delay means for accomplishing this may include a bimetal contact connected in such a way as to maintain the water valve solenoid 134 energized for the short additional time period, it may include a heater element such as the sequencer heater element 174, or it may include some other suitable timer circuit or device. The purpose of the delay feature, which is an optional feature, is to reduce or minimize the cycling frequency of the water valve and thereby also reduce the noise produced by the device. Reducing the cycling frequency also cuts down on wear and tear on the water valve 30 and hence on maintenance. It is preferred, however, to use a normally closed water valve so that if the device should fail, or if the power to the circuit is interrupted for some reason, water will not be fed into the tank with the consequent bad effects that might otherwise result.

The subject humidifier 20 is initially turned on by moving the switch contact 96 into engagement with the stationary switch contact 118. Before the device can be operated the push button switch 148, sometimes also called the reset switch, must have been depressed for the required time period usually greater than about forty-five seconds. Thereafter when the humidistat 80 calls for additional humidity, a circuit is produced by switch means in the humidistat (not shown) on the conductor 140 to the terminal 142 of the control relay 100 and through means therein to the terminal 154 and the lead 156 to energize the heater element solenoid 158 and the heater element 34 to produce steam. This circuit includes the lead 160 and has a connection 188 to one side of the furnace blower relay (not shown). This connection is provided to make sure that the furnace blower will always be energized when steam is being produced in the subject humidifier and fed into the plenum chamber 14. The solenoid 158 also has contacts (not shown) which are in a high voltage circuit that is provided to energize the heater element 34. The high voltage leads are indicated by the numbers 77 and 78 and numbers 190 and 192.

If, at the time the heater element 34 is energized, the water in the tank chamber 24 is making contact with the probe 32, the water valve solenoid 134 will not be energized and no water will be added. Since more humidity is being called for, however, the heater element 34 is energized, and the connection 188 assures that the furnace blower is also energized. The energizing of the heater element 34 boils and vaporizes the water in the tank 22 producing steam which escapes through the outlet conduit 38 and is fed into the plenum chamber 14.

If the humidity level in the controlled environment is at or greater than the predetermined humidity level as determined by the humidistat 80, the heater element 34 will remain de-energized, and the furnace blower will not be energized as a result of operation of the humidifier 20 but may be energized and de-energized to force hot air out from the furnace as required depending on operation of a thermostat (not shown). The important thing is that the furnace blower always be energized when the heater element 34 is energized so that the steam produced will always be introduced into a moving air stream. When the subject device is in its standby mode which is the mode when it is not producing steam, the only electric energy required is the energy necessary to energize the yellow indicator light 106, the sequencer heater 174 and possibly also a coil or other element in the control device 100.

Thus there has been shown and described a humidifier device which fulfills all of the objects and advantages sought therefor. It will be apparent to those skilled in the art, however, that many changes, modifications, variations and other uses and applications of the subject device are possible and contemplated. All such changes, modifications, variations and other uses and applications which do not depart from the spirit and scope of the invention are deemed to be covered by the invention which is limited only by the claims that follow.

What is claimed is:

1. A device for delivering humidity to an environment and for maintaining a desired humidity level in said environment comprising a substantially closed housing for containing a supply of water to be vaporized, means for feeding water into said housing including a source of water and means for controlling the flow of water from said source into said housing, said water flow control means including controllable valve means, actuable means operable to enable the valve means to be energized when the water level in said housing falls below a desired water level, a single probe responsive to detection of the desired water level in said housing and first timer means energized by said probe when the water level in the housing rises sufficiently to initially make contact with the probe to energize the first timer means to maintain the valve means energized for a predetermined time interval and thereafter to deenergize the valve means to prevent the flow of water from said source into said housing, said probe including an electrically conductive sensing element attached to said housing at an upper location and extending downwardly in the housing to a free end at an intermediate location therein which represents the desired water level, the position of the free end of said sensing element completing an electric circuit with the water when the water is in contact therewith, said actuatable means including second timer means to effect deenergization of said valve means and prevent reenergization thereof and further admission of water into the housing if a water filling operation under control of the first timer means exceeds some predetermined time, a heater element in said housing at an elevation below the free end of said sensing element in contact with the water, a humidity sensing control device located in the environment to be controlled including means settable to establish a predetermined desired humidity level to be maintained therein, means operatively connecting said control device to the heater element to energize the heater element to vaporize water contained in the housing when the level of humidity in the controlled environment is below the predetermined level to be maintained, and outlet means on said housing through which the vaporized water can pass, said outlet means including a conduit having one end connected to the housing and an opposite open end positioned to discharge vaporized water into the environment where the predetermined humidity level is being maintained.

2. The device defined in claim 1 wherein said valve means include a solenoid operated valve, the sensing element is an electrically conductive probe positioned in the housing and extending downwardly therein from an upper location, and including a non-vaporizable electrolytic substance contained in the water in the housing, and means operatively connecting said probe in circuit with the solenoid operated valve to control the energizing and deenergizing thereof depending upon whether the water level in the housing is in contact with the free end of the probe.

3. The device defined in claim 1 for use with a furnace having a plenum chamber, said opposite end of said conduit being open and positioned to discharge vaporized water into the plenum chamber.

4. The device defined in claim 3 wherein the furnace has blower means for blowing hot air produced in the furnace into the plenum chamber, and circuit means operatively connecting the blower means in circuit with the heater element including circuit means constructed so that the heater element can only be energized when the blower means are also energized.

5. The device defined in claim 1 wherein said housing includes a cylindrical wall oriented in a substantially horizontal position and end wall means substantially closing the opposite ends of said cylindrical wall.

6. The device defined in claim 1 wherein said source of water includes a source of hot water.

7. The device defined in claim 1 including electric indicator means and circuit means associated therewith to indicate the operating mode thereof, said indicator means including first indicator means energizable when the device is in an operative condition, second indicator means energizable to indicate when the device is in an inoperative condition, and third indicator means energizable to indicate when the valve means are in an open condition feeding water from the water source into the housing.

8. A humidifier device for delivering humidity to an environment and for maintaining a desired humidity level in said environment comprising a substantially closed housing having a single chamber therein for holding a supply of water to be vaporized, water flow control means including electric controlled normally closed valve means, means to energize and open said valve means and to feed water into said housing chamber when the water level therein falls below a desired water level, said flow control means including means responsive to a predetermined level of water in said housing to effect deenergization and closing of said valve means to prevent the further feeding of water into said housing chamber, said means responsive to a predetermined water level including a single probe element attached to said housing at an upper location and extending downwardly therefrom to a free end at an intermediate location in said housing chamber, means including a first timer device to maintain the valve means in an energized open condition feeding water into the housing for a predetermined time interval after the water level in the housing has risen to establish initial contact with said probe element and to thereafter deenergize the water valve, a second timer device including means responsive to the time duration of each energization of the valve means and operable to effect deenergization of the valve means and prevent reenergization thereof if any water filling operation exceeds some predetermined time interval, heater means extending into said housing chamber below said intermediate location in position to be immersed in the water maintained therein, humidity sensitive means located to respond to the level of humidity within said environment, circuit means operatively connecting said humidity sensitive means to the heater means to controllably energize the heater means to heat and vaporize water contained in said housing chamber, and outlet means connected to said housing above said intermediate location through which the vaporized water can pass, said outlet means including an open ended conduit having one end connected to discharge water vapor for delivery into the environment to be humidified.

9. A device for adding humidity to an environment and for maintaining a predetermined level of humidity in said environment comprising a tank having a chamber therein for holding a supply of water to be vaporized, water inlet means into said chamber, a source of water, valve means in the water inlet means and electric circuit means for controlling the energizing of the valve means and regulating the water flow into said chamber, said valve means being energized when the water in the chamber falls below a predetermined level, said circuit means including a first circuit portion including a single probe element positioned extending downwardly into the tank to a predetermined lower end for establishing and responding to the predetermined level of water in the chamber, a second circuit portion including a first timer device under control of the first circuit portion including means to maintain the valve means in an energized condition for a predetermined time interval after the water level in the chamber has reached said predetermined level and made initial contact with the lower end of the probe element, an electric heater element in the chamber and means including humidity sensitive means in the environment operable to establish a circuit for energizing the heater element whenever the humidity level in the environment is below a preset level to cause steam to be produced in the chamber, output means connected to said tank at a location above the level of the water therein through which the steam produced in said chamber can escape, said outlet means including an open ended conduit having one end connected to the tank and an opposite end positioned for delivering the escaping steam for introduction into the environment, second timer means in the electric circuit means for preventing subsequent energization of the valve means if any one operation thereof exceeds some predetermined time period, and means to reset the second timer means to reestablish conditions to enable energizing of the valve means.

10. A device for adding humidity to an environment and for maintaining a predetermined level of humidity in said environment comprising a tank having a chamber therein for holding a supply of water to be vaporized, water inlet means into said chamber including a source of water, valve means for regulating the water flow into said chamber and a conduit connecting said water source and said valve means, electric circuit means for regulating the opening and closing of said valve means and thereby controlling the level of water maintained in said chamber, said circuit means including first and second circuit portions, said first circuit portion including a single probe attached to the tank at an elevated position and extending downwardly therein to a predetermined level of water in the chamber to control the energizing of said valve means, said probe establishing electric contact with the water in the tank when the water rises to said predetermined level, said second circuit portion including timer means to maintain the valve means in an energized condition for a predetermined time interval after the water level in the chamber has reached said predetermined level, second timer means responsive to the time duration of each energizing of the valve means including means to prevent automatic reenergizing of the valve means if any energization thereof exceeds some preestablished time interval, electric means for heating the water in said chamber sufficiently to produce steam, said heating means including a heater element at least a portion of which is immersed in the water in the chamber, means responsive to the level of humidity within said environment to controllably energize said heater element, and outlet means connected to said tank at a location above the level of the water therein through which steam produced in said chamber can escape, said last named means including means for introducing the escaping steam into the environment being controlled.

11. The device defined in claim 10 wherein said second circuit portion includes a bi-metal member operatively connected to maintain the valve means in an energized condition for a predetermined time interval.

12. The device defined in claim 10 wherein said circuit means includes a switch having a first operative position for energizing the subject device, a second operative position for deenergizing the subject device, and a third operative position in which the subject device is in a standby condition.

13. The device defined in claim 10 including solenoid operated switch means operatively connected to the means responsive to the level of humidity within said environment, said solenoid operated switch means having electrical connections to a source of energy and other electrical connections to the heater element.

14. The device defined in claim 13 wherein said device is operated in association with a furnace having a plenum chamber and a blower for blowing hot air from the furnace into the plenum chamber and out into the controlled environment, and means operatively connecting the furnace blower with the heater element, said operatively connecting means including circuit means to assure that the furnace blower is energized whenever the heater element is energized.

15. The device defined in claim 10 wherein the means responsive to the level of humidity within the environment include an humidistat.

16. The device defined in claim 10 wherein said source of water is a source of hot water.

17. The device defined in claim 10 wherein said outlet means through which the steam escapes include a first conduit portion of predetermined diameter having opposite ends one of which is connected to and communicates with the tank chamber, and a second conduit portion of smaller diameter than the first conduit portion having one end connected to the other end of said first conduit portion, said second conduit portion having an opposite free end positioned to introduce the escaping steam into the environment being controlled, said opposite free end of the second conduit portion being located at a higher elevation than the one end of the first conduit portion.

18. The device defined in claim 10 wherein said outlet means through which the steam escapes includes a conduit line having opposite open ends one of which communicates with the tank chamber, the other of which is positioned to introduce the escaping steam into the environment being controlled, said conduit line extending from the tank upwardly so as to drain any steam which condenses to water as it passes therethrough back to the tank.

* * * * *